US006718557B2

(12) United States Patent
Claro

(10) Patent No.: US 6,718,557 B2
(45) Date of Patent: Apr. 13, 2004

(54) BASEBALL STYLE HAT WITH SIZE ADJUSTMENT

(76) Inventor: Felipe Claro, Apoquindo 3721, 13th Floor, Los Condes, Santiago 6760352 (CL)

( * ) Notice: Subject to any disclaimer, the term of this patent is extended or adjusted under 35 U.S.C. 154(b) by 0 days.

(21) Appl. No.: 10/097,030

(22) Filed: Mar. 12, 2002

(65) Prior Publication Data

US 2003/0172439 A1 Sep. 18, 2003

(51) Int. Cl.[7] ..... A42B 1/00

(52) U.S. Cl. ..... 2/195.2; 2/209.3; 2/209.11; 2/209.12

(58) Field of Search ..... 2/209.11–209.12, 2/209.3–209.5, 195.1–195.4, 918

(56) References Cited

U.S. PATENT DOCUMENTS

| | | | | | |
|---|---|---|---|---|---|
| 2,160,513 | A | * | 5/1939 | Pasternak | 2/183 |
| 4,023,212 | A | * | 5/1977 | Huffman | 2/195.2 |
| 4,274,157 | A | | 6/1981 | Boden | |
| 4,864,662 | A | * | 9/1989 | Frank | 2/183 |
| 5,012,532 | A | | 5/1991 | Krystal | |
| 5,091,995 | A | * | 3/1992 | Oates | 2/209 |
| 5,142,705 | A | * | 9/1992 | Edwards | 2/418 |
| 5,239,704 | A | | 8/1993 | Cornelio et al. | |
| 5,331,687 | A | | 7/1994 | Kronenberger | |
| 5,428,843 | A | | 7/1995 | Clowers et al. | |
| 5,548,845 | A | | 8/1996 | Gallup | |
| 5,584,076 | A | * | 12/1996 | Armstrong | 2/195.2 |
| 5,634,575 | A | | 6/1997 | Scharrenberg | |
| 5,669,076 | A | * | 9/1997 | Steffy | 2/195.2 |
| 5,799,334 | A | | 9/1998 | Griffith et al. | |
| 5,855,023 | A | | 1/1999 | Clingenpeel et al. | |
| 5,860,167 | A | | 1/1999 | Lizio | |
| 5,870,772 | A | | 2/1999 | Sprouse | |

* cited by examiner

*Primary Examiner*—Katherine Moran
(74) *Attorney, Agent, or Firm*—Jackson & Co., LLP

(57) ABSTRACT

An adjustable baseball or sports type hat is disclosed having an adjustable circumferential portion along the bottom of the crown. A visor may be attached to the front portion of the crown. At least two, but eventually four, two-part adjustment clasps are affixed near each temple of the crown to alter the size of the circumferential portion of the crown. Preferably, the adjustment clasps are hidden when adjusted for the wearer. This is accomplished by embedding one part of the adjustment clasp in or from a detachable flap, which can be created by leaving a part of adjacent triangular sections unsewn. The other part of the clasp is attached to the adjacent crown section, near the visor zone or front.

10 Claims, 3 Drawing Sheets

BASEBALL STYLE HAT WITH SIZE ADJUSTMENT

BACKGROUND OF THE INVENTION

1. Field of the Invention

The invention relates to baseball or sporting type hats and in particular to adjustable baseball style hats that more resemble traditional fitted hats where the adjustment parts are generally symmetric in each side of the hat.

2. Description of the Related Art

Baseball or sports style hats are available in several styles. In the traditional style, the crown of the hat is made in a range of sizes and a user selects a hat to fit his head. The disadvantage of this style is that a vendor has to stock hats in many different sizes to accommodate different head sizes. The advantage of this traditional style is that the entire crown of the hat is made of material and no provisions are necessary to adjust the hat.

In recent years the "one-hat-fits-all" baseball hat has become very popular. An adjustment mechanism, such as a pair of plastic straps or Velcro® straps, one a hook strap and the other a loop strap, are affixed at the back of the cap. The hat size is adjusted by altering the circumference of the crown by changing the position of the adjustment mechanism.

This style has several disadvantages. First, it requires a cut out or slit portion in the back of the crown where the straps of the adjustment mechanism are attached. This makes the hat unsightly in appearance. Second, it is popular to wear baseball style hats backwards, i.e., with the bill or visor at the back of the wearer's head instead of the front. In such case, the part of the head located at the split portion remains exposed to the weather conditions. With the traditional style hat this backwards wearing is both aesthetically pleasing and comfortable since the hat's material rests against the forehead of the wearer. But with the "one-hat-fits-all" style hat, the adjustment straps are on the forehead of the wearer. This is both unsightly and uncomfortable.

OBJECTS AND SUMMARY OF THE INVENTION

It is an object of the invention to provide a baseball style hat with or without visor which is neat in appearance and can be worn backwards without having a crown cut-out and adjustment mechanism on the wearer's forehead or back head.

Another object of the invention is to provide a baseball style hat with or without visor which is adjustable, but which does not have an adjustment mechanism in the back of the crown, at a cut-out of the crown.

A further object of the invention is to provide a baseball style hat with or without visor which has two or more adjustment clasps which may be symmetrically located in both sides of the hat when the hat is worn by a user.

An additional object of the invention is to provide a baseball style hat with or without visor which has two or more adjustment clasps which are hidden from view when the hat is worn by a user.

In accordance with the invention, an adjustable hat is provided which has a crown, preferably made of a plurality of triangular sections forming an apex at its top and having an adjustable portion along its lower part. A visor may be attached to the front or rear portion of the crown. At least two, but eventually four, of two-part adjustment clasps are affixed near each temple of the crown to alter the size of the lower portion of the crown.

In the preferred embodiment, the adjustment clasps are hidden or almost hidden when adjusted for the wearer. This is accomplished by embedding one part of the adjustment clasp in or from a detachable flap, which can be created by leaving all, or a part of, adjacent triangular sections unsewn in both sides of the hat. The other part of the clasp is attached to the adjacent crown section, near the visor zone or forehead area. It can also be attached to the opposite side of the hat.

The two part adjustment clasp can be a pair of straight or curved plastic straps, one having male connector portions and the other female connector portions, of the type well known in baseball style hats. However, the male-female connectors can be closer than commonly used in these kind of hats. Alternately, the adjustment clasp can be a pair of Velcro® straps, a textile strap with a buckle or similar fastener or even an elastic strap, also well known in the art.

DETAILED DESCRIPTION

Figure 1:
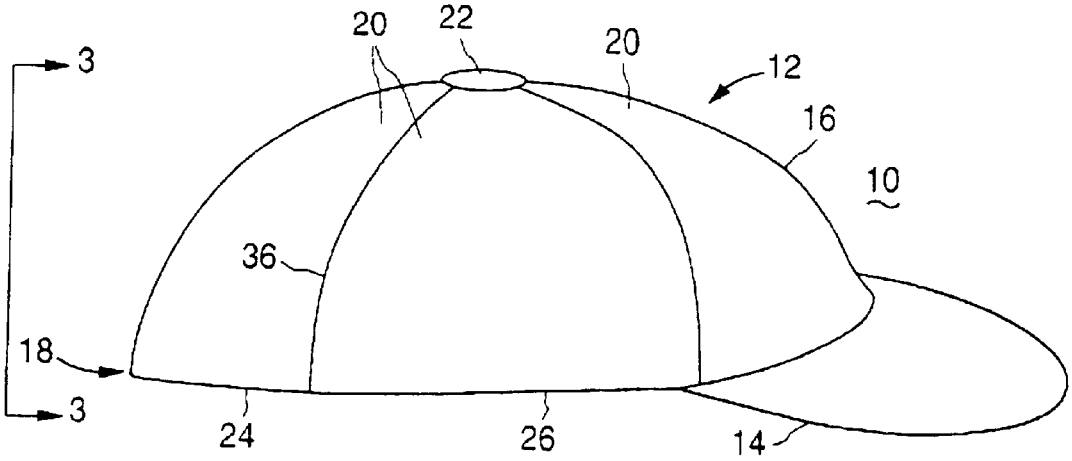
FIG. 1 is a side elevation view of the adjustable hat of the present invention.
Figure 2:
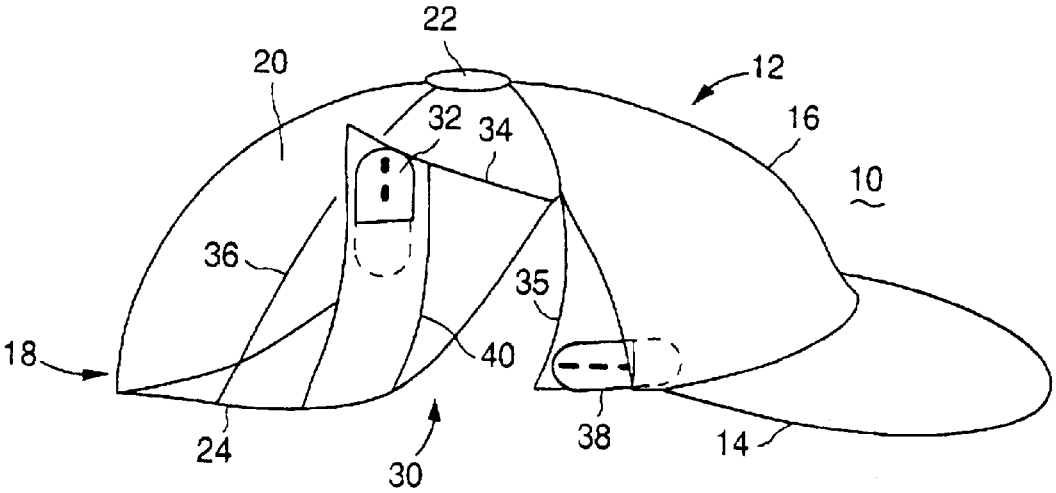
FIG. 2 is a side elevation view of the adjustable hat of the present invention showing one adjustment clasp arrangement.
Figure 3:
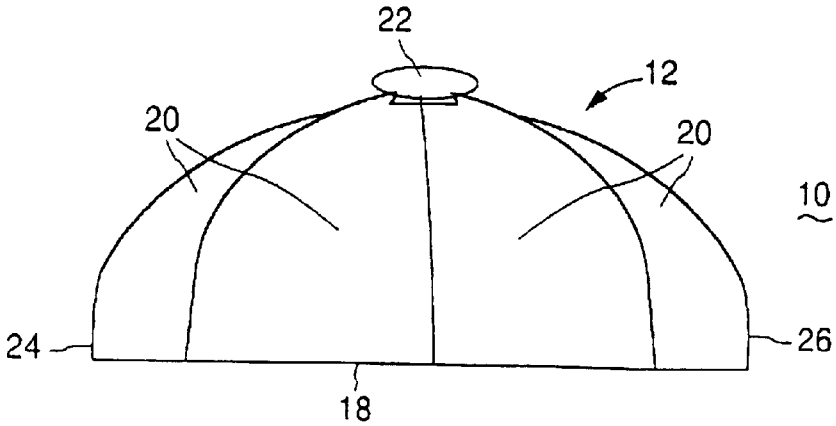
FIG. 3 is a back view of the hat of FIG. 1 in a direction of the arrows shown in FIG. 1.

FIGS. 1–3 illustrate one embodiment of the adjustable hat 10 of the present invention. The hat has a crown 12 and a may have a bill or visor 14 attached to the front portion 16 of the crown 12. As can be seen in FIGS. 2 and 3, the back portion 18 looks like the traditional baseball style hat, e.g., there is a solid expanse of material with no slits and no visible adjustment mechanism or clasp.

In the preferred embodiment, the crown is made up of a plurality of triangular or pie-shaped pieces 20 of material such as cotton, wool or synthetic material. With one or more exceptions the triangular crown pieces 20 are sewn together, with the tips of the triangular pieces defining an apex 22, which is typically hidden by a button 23 as shown. The bottoms of the triangular pieces define the circumferencial portion 24 of the hat 10.

FIG. 2 illustrates one embodiment of the improved adjustment mechanism or clasp 30 of the present invention comprising a first plastic strap 32 located in a flap 34 in the triangular temple piece 36 of the crown. A second part of the clasp comprises a second plastic strap 38 located in a flap 35 located in the adjacent triangle forming the crown where or near where the visor 14 joins the crown. Conveniently, the first and second plastic straps are sewn or fixed into the sweat band 40 of the hat, as indicated by the dashed lines. The plastic straps 32 and 38 are conventional or narrower and or curved, with one having a plurality of male connectors and the other a plurality of receptor holes. The size of the hat is determined by the amount of overlap of the straps 32 and 38 when attached to each other.

Unlike the conventional "one-size-fits-all" style, the adjustment clasps are not located at the back of the hat. Rather, they are generally located at both sides of the hat at any or two sides of the temple portion 26 of hat 10. Additionally, in the preferred embodiment, the adjustment clasps are generally hidden, without the necessity of the slit in the crown, as is the case with the typical "one-size-fits all" style hat. In the preferred embodiment there are two adjustment clasps, one at each side of the hat, at temple portion of the crown near where the bill or visor 14 joins the crown 12.

Figure 4:
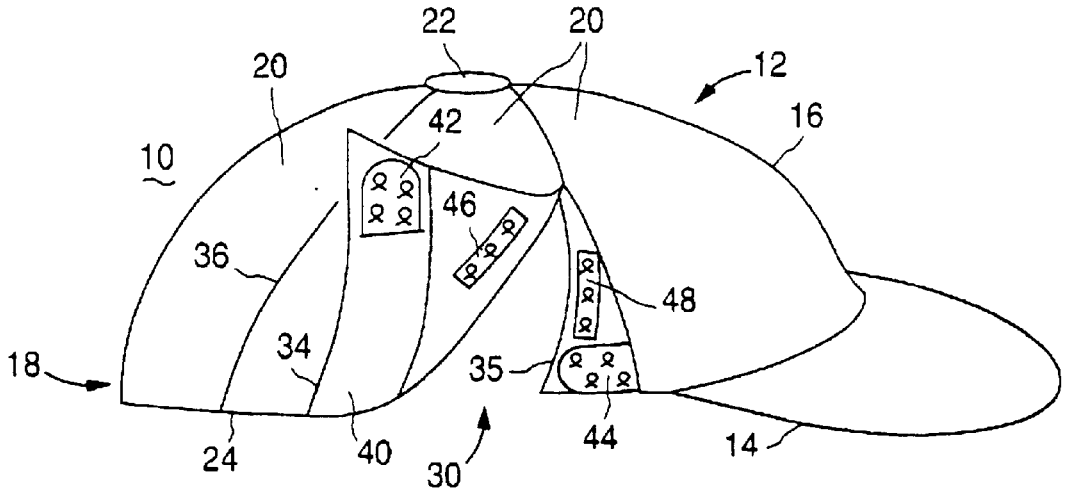
FIG. 4 is a side elevation view of the adjustable hat of the present invention showing another adjustment clasp arrangement.
Figure 5:
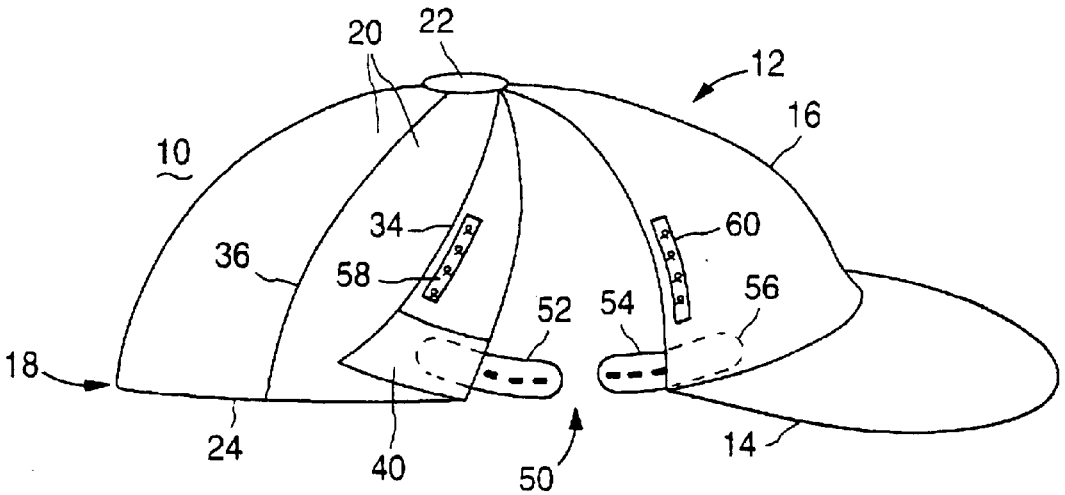
FIG. 5 is a side elevation view of the adjustable hat of the present invention showing yet another adjustment clasp arrangement.

As illustrated in FIG. 2, as well as FIGS. 4 and 5, the clasps 30 are provided in a manner such that they are not seen when adjusted to the wearer's size, as shown in FIGS. 1 and 3. The first part 32, located in the flap 34 is hidden from view when it is attached to the second part of the clasp 38. In the preferred embodiment, flap 34 is created by leaving unsewn all, or a part, of the temple triangle 36 to the adjacent triangular section.

FIG. 4 shows another embodiment of the present invention. In this embodiment the clasp 30 comprises first and second Velcro® straps 42 and 44, with one being the hook strap and the other the loop strap. The circumference of the hat, and hence its size, is adjusted by the amount of overlap of the straps 42 and 44.

FIG. 4 also illustrates another feature of the invention. Velcro® strips 46 and 48 may be located along the flap 34 triangle and adjacent triangle flap 35. These strips allow the detachable triangular sections to be joined together once the adjustment clasp has been adjusted for the user.

FIG. 5 illustrates another embodiment of the present invention. Here the clasp 50 made up of connectors 52 and 54 have a slightly curved or arcuate shape to more naturally follow the contours of the circumference of the hat 10. One end of connector 52 fits into a recess of the crown triangle 36. Similarly, end 56 of connector 54 is recessed within the crown 12.

In this embodiment, fold 34 of the crown triangle 36 extends all the way to the apex 22. Velcro® strips 58 and 60 provide a mating surface for the flap 34 and the adjacent crown triangular section. Note that the width of the connectors 52 and 54 are preferably narrower than the single set of connectors typically found in the "one fits all" type of hat. Also, the embedded ends of connectors 52 and 54 can also be narrower than the connector portions. It should be understood that other clasps or adjustment mechanisms can be employed. Also, while keeping the adjustment clasps hidden is preferred, they may be provided on the outside of the crown where they are visible.

Figure 6A:
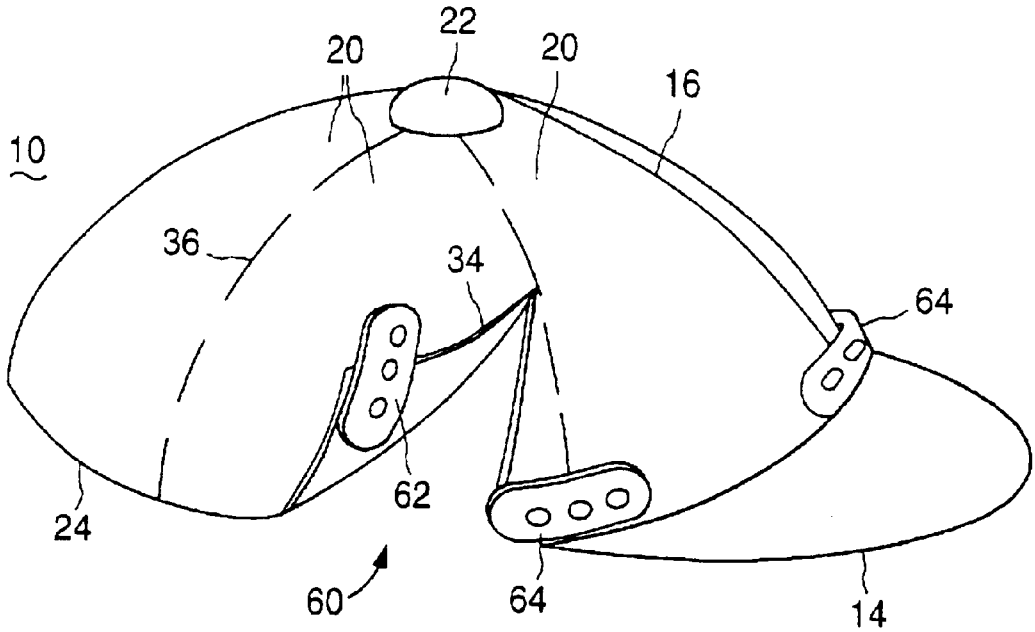
FIGS. 6A and 6B are front elevation views of the adjustable hat of the present invention showing yet another adjustment clasp arrangement.
Figure 6B:
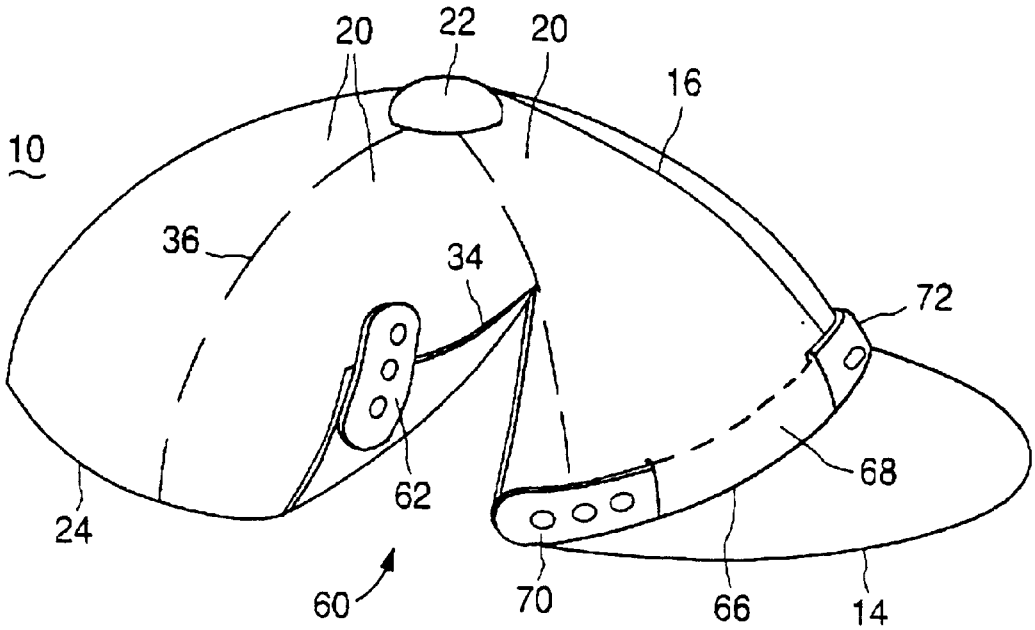

Another embodiment of the invention is shown in FIGS. 6A and 6B. In FIG. 6A the adjustment mechanism 60 includes a first pair of connectors, 62 and 64, which are attached to flap 34 of temple triangle 36 and to the front portion/triangle 16, respectively. A second pair of the same connectors 62 (not shown) and 64, are provided on the other side of the hat 10. Here mating connectors 64 are attached to the outside of the front portion 16 of hat 10. For example, connectors 64 can be the male connectors and connectors 62 the female connectors.

FIG. 6B is similar to the embodiment of FIG. 6A except that instead of two separate connectors 64, a single plastic strip 66 is embedded in the front portion of the hat 10 along the brim of the hat where the visor 14 is joined. The central area 16 is enclosed in fabric at the front portion or triangle 16. Ends 70 and 72 adjustably engage the pair of connectors 62. Of course, other types of adjustment clasps can be used, such as Velcro®.

The present invention is not limited to the particular connector or adjustment mechanisms described herein. For example, other types of connector mechanisms can be used, such as buckles, tooth-type clasps, and elastic band connectors can be used. Also, the present invention is not limited to baseball or sports-type hats. It is equally applicable for other types of hats, such as hats without visors.

What is claimed is:

1. An adjustable hat comprising:

a crown having top, front, back and temple portions and having a symmetrical open bottom having a circumferential portion;

a visor/bill affixed at the front or rear of the crown;

a pair of adjustment mechanisms each located generally at the temple portion of the crown to alter the size of the circumferential portion of the crown;

wherein each of the adjustment mechanism has a first part and a second part which adjustably connect with each other;

wherein the first part of each of the adjustment mechanisms is located within a detachable part of the crown;

wherein the first and second parts of each of the adjustment mechanisms comprise adjusting straps which are attachable and detachable with each other to a desired circumferential crown size; and wherein the detachable parts of the crown comprise flap portions and the first parts of each of the adjustment mechanisms are embedded within the flaps and the second parts of each of the adjustment mechanisms are embedded within the temple portions of the crown.

2. An adjustable hat comprising:

a crown having top, front, back and temple portions and having a symmetrical open bottom having a circumferential portion;

a visor/bill affixed at the front or rear of the crown;

a pair of adjustment mechanisms each located generally at the temple portion of the crown to alter the size of the circumferential portion of the crown, and wherein each of the crown portions includes a flap portion and the first part of the adjustment mechanism is embedded within the flap and the second part of the adjustment mechanism is embedded within the temple portion of the crown.

3. An adjustable hat comprising:

a crown having an apex at its top and having an adjustable circumferential portion at its bottom and having front and back portions and two side portions;

a visor attached to the front portion of the crown;

a pair of two-part adjustment clasps to alter the size of the circumferential portion of the crown;

a plurality of triangular sections forming the crown, with the points of the triangles defining the apex of the crown;

wherein a pair of the triangular crown sections at the temple portions are detachable from each other;

wherein one part of the adjustment clasp of each pair of adjustment clasps is embedded in one of the detachable pair of triangular crown sections and the other part is embedded in the other detachable triangular crown section; and wherein each of the two part adjustment clasps comprises a pair of hook and loop ® straps.

4. An adjustable hat comprising:

a crown having an apex at its top and having an adjustable circumferential portion at its bottom and having front and back portions and two side portions;

a visor attached to the front portion of the crown;

a pair of two-part adjustment clasps to alter the size of the circumferential portion of the crown;

a plurality of triangular sections forming the crown, with the points of the triangles defining the apex of the crown;

wherein a pair of the triangular crown sections at the temple portions are detachable from each other;

wherein one part of the adjustment clasp of each pair of adjustment clasps is embedded in one of the detachable pair of triangular crown sections and the other part is embedded in the other detachable triangular crown section; and wherein the detached pair of triangular crown sections are attachable by means of a hook and loop ® attachment strip.

5. An adjustable hat comprising:

a crown having an apex at its top and having an adjustable circumferential portion at its bottom and having front and back portions and two side portions;

a visor attached to the front portion of the crown;

a pair of two-part adjustment clasps to alter the size of the circumferential portion of the crown;

a plurality of triangular sections forming the crown, with the points of the triangles defining the apex of the crown;

wherein a pair of the triangular crown sections at the temple portions are detachable from each other;

wherein one part of the adjustment clasp of each pair of adjustment clasps is embedded in one of the detachable pair of triangular crown sections and the other part is embedded in the other detachable triangular crown section; and wherein the detachable pair of triangular crown sections are selectively attached with hook and loop attachment devices.

6. An adjustable hat comprising:

a crown having top, front, back and temple portions and having a symmetrical open bottom having a circumferential portion;

a pair of adjustment mechanisms each located generally at the temple portion of the crown to alter the size of the circumferential portion of the crown;

wherein each of the adjustment mechanisms has a first part and a second part which adjustably connect with each other;

wherein the first part of each of the adjustment mechanisms is located within a detachable part of the crown; and wherein the detachable parts of the crown comprise flap portions and the first parts of each of the adjustment mechanisms are embedded within the flaps and the second parts of each of the adjustment mechanisms are embedded within the temple portions of the crown.

7. An adjustable hat comprising:

a crown having top, front, back and temple portions and having a symmetrical open bottom having a circumferential portion;

a pair of adjustment mechanisms each located generally at the temple portion of the crown to alter the size of the circumferential portion of the crown; and wherein each of the crown portions includes a flap portion and the first part of the adjustment mechanism is embedded within the flap and the second part of the adjustment mechanism is embedded within the temple portion of the crown.

8. An adjustable hat comprising:

a crown having top, front, back and temple portions and having a symmetrical open bottom having a circumferential portion;

a pair of adjustment mechanisms each located generally at the temple portion of the crown to alter the size of the circumferential portion of the crown;

wherein each of the adjustment mechanisms has a first part and a second part which adjustably connect with each other;

wherein the first part of each of the adjustment mechanisms is located within a detachable part of the crown; and wherein the second part of each of the adjustment mechanisms comprises a single strip extending across the front portion of the cap, and having a central portion embedded within the front portion of the hat.

9. An adjustable hat comprising:

a crown having top, front, back and temple portions and having a symmetrical open bottom having a circumferential portion;

a visor/bill affixed at the front or rear of the crown;

a pair of adjustment mechanisms each located generally at the temple portion of the crown to alter the size of the circumferential portion of the crown;

wherein each of the adjustment mechanism has a first part and a second part which adjustably connect with each other;

wherein the first part of each of the adjustment mechanisms is located within a detachable part of the crown; and wherein the second part of each of the adjustment mechanisms comprises a single strip extending across the front portion of the cap, and having a central portion embedded within the front portion of the hat.

10. An adjustable hat comprising:

a crown having an apex at its top and having an adjustable circumferential portion at its bottom and having front and back portions and two side portions;

a visor attached to the front portion of the crown;

a pair of two-part adjustment clasps to alter the size of the circumferential portion of the crown;

a plurality of triangular sections forming the crown, with the points of the triangles defining the apex of the crown;

wherein a pair of the triangular crown sections at the temple portions are detachable from each other;

wherein one part of the adjustment clasp of each pair of adjustment clasps is embedded in one of the detachable pair of triangular crown sections and the other part is embedded in the other detachable triangular crown section; and wherein the other part of the adjustment clasp of each pair of adjustment clasps comprises a single strip extending across the front portion of the cap, and having a central portion embedded within the front portion of the hat.

* * * * *